US008336977B2

(12) United States Patent
Narushima et al.

(10) Patent No.: US 8,336,977 B2
(45) Date of Patent: Dec. 25, 2012

(54) PRINTER, SUPPLIED POWER CONTROLLER AND COMPUTER PROGRAM

(75) Inventors: Toshio Narushima, Kanagawa (JP); Naohide Koumura, Aichi (JP)

(73) Assignee: Sony Corporation, Tokyo (JP)

( * ) Notice: Subject to any disclaimer, the term of this patent is extended or adjusted under 35 U.S.C. 154(b) by 663 days.

(21) Appl. No.: 11/713,292

(22) Filed: Mar. 2, 2007

(65) Prior Publication Data

US 2007/0211096 A1 Sep. 13, 2007

(30) Foreign Application Priority Data

Mar. 13, 2006 (JP) ..... P2006-067655

(51) Int. Cl.
*B41J 29/38* (2006.01)

(52) U.S. Cl. ..... 347/5; 323/371

(58) Field of Classification Search ..... None
See application file for complete search history.

(56) References Cited

U.S. PATENT DOCUMENTS

| | | | | |
|---|---|---|---|---|
| 6,380,715 | B1 * | 4/2002 | Kubo | 320/128 |
| 6,693,782 | B1 * | 2/2004 | Lash | 361/93.9 |
| 2004/0201636 | A1 * | 10/2004 | Sato et al. | 347/9 |
| 2005/0078024 | A1 * | 4/2005 | Harrington | 341/155 |

FOREIGN PATENT DOCUMENTS

| | | |
|---|---|---|
| JP | 03-75181 | 3/1991 |
| JP | 07-322528 | 12/1995 |
| JP | HEI 07-322528 | 12/1995 |
| JP | 10-250190 | 9/1998 |
| JP | HEI 10-250190 | 9/1998 |
| JP | 2000-089620 | 3/2000 |
| JP | 2002-108725 | 4/2002 |
| JP | 2002-199588 | 7/2002 |
| JP | 2004-025731 | 1/2004 |
| JP | 2004-236492 | 8/2004 |
| JP | 2005-215239 | 8/2005 |

OTHER PUBLICATIONS

Derwent Abstract for JP 2004-236492 A.*
Machine translation for JP 2004-236492 A.*
Translation of JP 03-075181 A.*
Translation of JP 2004-236492 A.*

* cited by examiner

*Primary Examiner* — Matthew Luu
*Assistant Examiner* — Justin Seo
(74) *Attorney, Agent, or Firm* — Robert J. Depke; Rockey, Depke & Lyons, LLC

(57) ABSTRACT

A printer includes: an inkjet print head; an image processing part that processes image data and supplies the data to the print head; a main power supply that is connected to a commercial power source and supplies first power to the print head; a rechargeable sub-power supply that supplies second power for supporting the first power to the print head when power necessary for driving of the print head exceeds the first power during execution of printing; and a switch part that is located on a power supply line and electrically connects the sub-power supply to the power supply line when the power necessary for driving of the print head exceeds the first power.

4 Claims, 10 Drawing Sheets

FIG. 12

| SUB-POWER SUPPLY CHARGING TIME (SEC) | MAIN POWER SUPPLY CAPACITY (A) | SUB-POWER SUPPLY CAPACITY (A) |
|---|---|---|
| 5 | 10.45 | 10.45 |
| 4 | 11.61 | 9.29 |
| 3 | 13.06 | 7.84 |
| 2 | 14.93 | 5.97 |
| 1 | 17.42 | 3.48 |

PRINTER, SUPPLIED POWER CONTROLLER AND COMPUTER PROGRAM

CROSS REFERENCES TO RELATED APPLICATIONS

The present invention contains subject matter related to Japanese Patent Application JP 2006-067655 filed in the Japanese Patent Office on Mar. 13, 2006, the entire contents of which being incorporated herein by reference.

BACKGROUND OF THE INVENTION

1. Field of the Invention

The invention to be proposed in the specification relates to a technology of realizing lower capacity of a main power supply provided in an inkjet printer.

The invention to be proposed by the inventors has aspects of a printer, a supplied power controller, and a computer program.

2. Background Art

Recently, there has been a need for faster printing speed together with higher definition of printing resolution in an inkjet printer. Accordingly, a power supply (main power supply) having a high power supply capacity is desirably provided in this type of printer.

By the way, in a printer used by an indefinite number of users, a wide variety of printing methods are desired.

For example, when a printer is used for business use, it is necessary to assume execution of high-speed printing for a long period and execution of solid printing (printing using all or almost all head elements). On the other hand, when a printer is used for personal use, such a usage pattern under the severe condition is rare.

However, it is necessary for general-purpose printers, except special printers for limited uses, to be intended for various usage patterns. Accordingly, a high-capacity power supply (main power supply) is provided in a general-purpose printer for the case of the heaviest load.

In this regard, there is a problem that the printer itself is upsized by providing a high-capacity power supply. In addition, the high-capacity power supply causes increase in weight and cost. Accordingly, lower capacity is desired for the main power supply.

JP-A-2005-215239 (patent document 1) discloses a copier provided with an auxiliary power supply separately from a main power supply for reduced warm-up time and maintenance of temperature of an image fixing unit.

SUMMARY OF THE INVENTION

In the case of patent document 1, the supply from the auxiliary power supply is typically executed when the temperature of the image fixing unit is lower than a temperature that enables printing. That is, the supply from the auxiliary power supply is executed for heating the image fixing unit to the temperature that enables printing or keeping the unit at a suitable temperature.

However, in an inkjet printer without the need for heat accumulation before the start of printing, the auxiliary power supply for the function disclosed in patent document 1 is not necessary. That is, the function of sensing the temperature of the image fixing unit and switching-controlling the supply from the auxiliary power supply during execution of printing is not necessary for the inkjet printer.

Further, in the copier of patent document 1, power consumption does not largely changes according to contents of printing. Accordingly, the power shortage (reduction in drive current and reduction in drive voltage) according to the contents of printing is not intended to be replenished. Furthermore, in the copier of patent document 1, the auxiliary power supply sometimes replenishes the power during continuous printing, however, this is due to reduction in temperature of the image fixing unit but not for replenishing the power shortage.

Thus, it is desirable to provide a mechanism capable of replenishing power from a rechargeable sub-power supply separately prepared from a main power supply when especially high power is necessary in an inkjet printer.

According to an embodiment of the invention, there is provided an inkjet printer including the following devices:

(a) a main power supply that is connected to a commercial power source and supplies first power to a print head;

(b) a rechargeable sub-power supply that supplies second power for supporting the first power to the print head when power necessary for driving of the print head exceeds the first power during execution of printing; and (c) a switch part that is located on a power supply line and electrically connects the sub-power supply to the power supply line when the power necessary for driving of the print head exceeds the first power.

For the opening and closing operation of the switch part, a mechanism to be autonomously executed based on the connection structure of the circuit itself or a mechanism to be controlled through a switch control part may be selected.

In this case, it is proposed that, as a supplied power controller that controls the opening and closing operation of the switch part according to contents of image data, a switch control part that sequentially calculates power necessary for formation of a print image corresponding to the image data and closing-controls the switch part to apply the second power to the supply line when the calculated power exceeds the first power is provided.

The supplied power controller may be realized in the form of a computer program.

Using the embodiments according to the invention proposed by the inventors, the capacity of the main power supply provided in the inkjet printer can be significantly reduced compared to the maximum power consumption. Accordingly, downsizing of the printer itself and reduction in manufacturing cost can be realized.

BRIEF DESCRIPTION OF THE DRAWINGS

FIG. 12 is a chart showing a relationship between the capacity ratio of the main power supply and the sub-power supply and the charging time of the sub-power supply.

DESCRIPTION OF PREFERRED INVENTION

Hereinafter, a configuration example of an inkjet printer according to an embodiment of the invention will be described.

Note that a widely known or publicly known technology in the art is applied to parts that are not specifically shown or described in the specification.

Further, embodiments described as below are one embodiments of the invention and the invention is not limited to the embodiments.

(A) System Configuration of Printer (A-1) Overall Configuration

Figure 1:
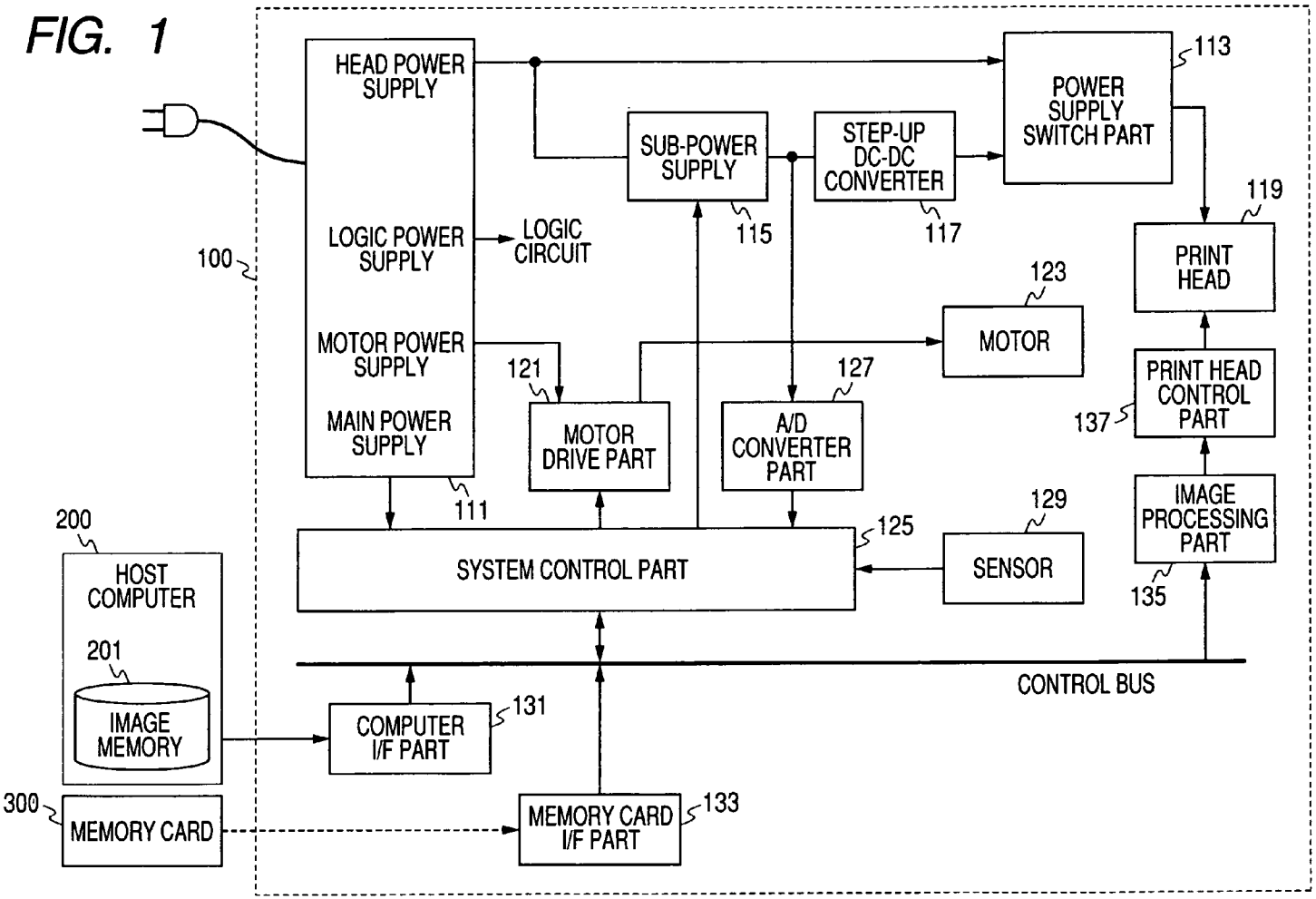
FIG. 1 shows a printing system example.

FIG. 1 shows a functional block configuration of a printing system using a printer 100.

The printer 100 is an inkjet printer. Further, the printer 100 is connected to a host computer 200 via a serial bus or network.

An image memory 201 is provided in the host computer 200 and image files are stored therein. In addition, the printer 100 also accommodates a function (direct-printing function) of loading an image file from an external memory medium and printing the file. In FIG. 1, the case of a memory card (semiconductor memory) 300 as a memory medium having an appearance in the form of a card is shown as an example of the external memory medium.

(A-2) Configuration within Printer

The printer 100 includes a main power supply 111, a power supply switch part 113, a sub-power supply 115, a step-up DC-DC converter 117, a print head 119, a motor drive part 121, a motor 123, a system control part 125, a A/D converter part 127, a sensor 129, a computer I/F part 131, a memory card I/F part 133, an image processing part 135, and a print head control part 137.

(a) Main Power Supply

The main power supply 111 is a power supply connected to an outlet of a commercial power source via a power supply cable. The main power supply 111 distributes power to the respective parts within the printer. For example, it supplies power from a head power supply through the power supply switch part 113 to the print head 119. Further, for example, it supplies power from a logic power supply to the respective parts within the printer. Furthermore, for example, it supplies power from a motor power supply to the motor drive part 121.

In the example, the head power supply is designed to allow 10.45-A-rated current flow under a voltage of 9.4 V. In this case, it is designed so that the power may be about a half of the maximum power consumption. The power is a sufficient amount of power for normal printing. Therefore, when the solid printing or high-speed continuous printing is not executed, the print head 119 can be driven only by the head power supply.

(b) Power Supply Switch Part

The power supply switch part 113 is a circuit part that selectively supplies the power (main power supply) supplied by the head power supply and the power (sub-power supply) supplied by the sub-power supply 115 to the print head 119.

The power supply line extending from the main power supply and the power supply line extending from the sub-power supply are connected to one power supply line within the power supply switch part 113. The power supply switch part 113 controls the electrical connection of the sub-power supply to the one power supply line.

When the current supplied from the main power supply 111 is sufficient as the power to be consumed in the print head 119, the power supply switch part 113 supplies only the main power to the print head 119.

On the contrary, when the current supplied from the main power supply 111 is not sufficient as the power to be consumed in the print head 119, the power supply switch part 113 supplies both the main power and the sub-power to the print head 119. Simultaneously, current flows to replenish the main power shortage from the sub-power supply to the print head 119.

That is, when the necessary current in the print head 119 is 10.45-A-rated current or less, the power supply switch part 113 supplies current only from the main power supply.

On the other hand, when the necessary current in the print head 119 exceeds 10.45-A-rated current, the power supply switch part 113 supplies the maximum current of 20.9 A as the sum of 10.45 A from the main power supply and the current from the sub-power supply.

(c) Sub-Power Supply

The sub-power supply 115 is an auxiliary power supply prepared for replenishing the power shortage when the power consumed in the print head 119 exceeds the normal power. The sub-power supply 115 includes an electric double layer capacitor or a secondary cell having a high capacity in units of farads. That is, it is a rechargeable power supply. In this example, the sub-power supply 115 having the power supply capacity that may supply current of 10.45 in terms of DC load is used.

Figure 2:
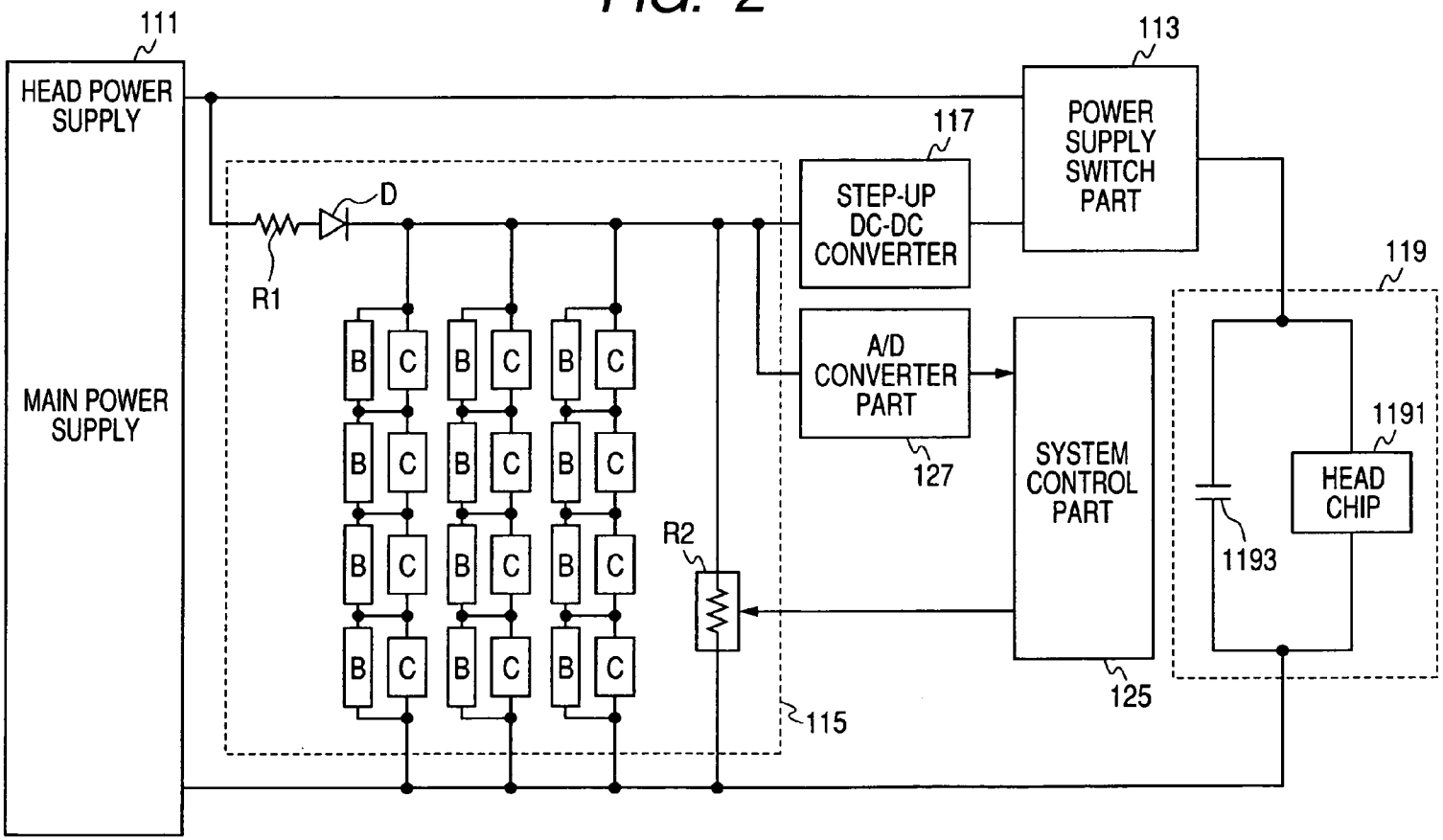
FIG. 2 shows internal structure examples of a sub-power supply and a print head.

FIG. 2 shows a circuit configuration when the sub-power supply 115 is realized by an electric double layer capacitor. The electric double layer capacitor involves no chemical reaction unlike a secondary cell. Accordingly, it enables rapid charge and discharge. Because of the property, high-capacity capacitors of this type are currently used for short-period backup as well.

The sub-power supply 115 is connected to a power supply line branched from the head power supply (main power supply). That is, the sub-power supply 115 is configured to charge the high-capacity capacitor with the power supplied from the main power supply.

Resistance R1 for current limitation and diode D for back-flow prevention are series-connected to the power supply line branched from the main power supply. The resistance R1 is a resistance for preventing excessive current to flow in. Further, the diode D is located so that the current of the high-capacity capacitor may not flow back toward the main power supply.

In this example, the high-capacity capacitor includes twelve capacitors C and twelve charge and discharge balance circuits B. Here, the respective four of the twelve capacitors C are connected in series and divided into three sets of series circuits. One charge and discharge balance circuit B is connected in parallel to one capacitor C. The charge and discharge balance circuit B acts not to apply an excessive voltage to the capacitor C at the time of charge and discharge.

In addition, the sub-power supply 115 has discharge circuit R2. The discharge circuit R2 is connected to the system control part 125 and used for discharging the charge of the sub-power supply 115 when the main power supply is turned off and error status causing abort of printing is detected.

(d) Step-Up DC-DC Converter

The step-up DC-DC converter 117 is a switching power supply that is connected to the power supply line of the sub-power supply 115 and raises and outputs the voltage of the high-capacity capacitor that has been reduced due to discharge. The voltage after step-up is supplied to the power supply switch part 113 like the main power. By the way, when the sub-power supply 115 is a secondary cell, the step-up DC-DC converter is not necessary. As below, the embodiment will be described on the assumption that the sub-power supply 115 is the high-capacity capacitor.

(e) Print Head

The print head 119 has a head structure of injecting fine ink droplets from a nozzle to a printed medium. Any injection system of ink droplets may be adopted in the print head 119. For example, a system of injecting ink droplets with the expansion force of air bubbles generated on heating by a heater, or a system of injecting ink droplets with the pressure caused by deformation of a piezoelectric element may be used.

Further, the print head 119 may be a serial head or line head.

The serial head refers to a print head that forms print images on a printed medium by combining the operation of reciprocation-scanning the print head in the main scan direction and the operation of moving the print head or the printed medium in the sub-scan direction. Further, the line head refers to a print head that has a line of nozzles arranged in a width longer than the print width and forms print images on a printed medium by moving the line head or the printed medium in the sub-scan direction.

FIG. 2 shows an equivalent circuit of the print head 119. The print head 119 is electrically equivalent to a circuit in which a capacitor for smoothing 1193 is connected to a head chip 1191 in parallel.

(f) Motor Drive Part

The motor drive part 121 is a device that controls the driving operation of the motor 123 provided within the printer. The details of driving, driving timing, etc. of the motor 123 are controlled through the system control part 125.

(g) System Control Part

The system control part 125 is a processing unit that controls the operation of the entire system. The system control part 125 includes a computer. That is, it has a CPU, ROM, and RAM as main component elements. A processing program is stored in the ROM. The CPU executes the processing program loaded from the ROM and controls the operation of the entire system. The RAM is a work area of arithmetic processing.

That is, the system control part 125 executes printing processing based on image data, processing commands, status information, etc. input from the host computer 200 and the memory card 300.

The connection between the host computer 200 and the printer 100 is made through the computer interface part 131.

The computer interface part 131 uses an interface for wired communication or an interface for wireless communication. For example, it uses an interface compliant with USB, Ethernet (registered trademark), Centronics, IrDA, Bluetooth, or IEEE802.11a/b/g.

Further, the connection between the printer 100 and the memory card 300 is made through the memory card interface part 133. Interfaces according to various card type memory media are used for the memory card interface part 133.

The connection between these interfaces to the system control part 125 is made via a control bus.

(h) A/D Converter Part

The A/D converter part 127 is a circuit that converts analog voltage values into digital voltage values so that the output voltage of the high-capacity capacitor may be monitored by the system control part 125.

(i) Sensor

The sensor 129 is one of various kinds of temperature sensor, printing error sensor, and remaining ink sensor arranged inside the printer. The detected values of these are supplied to the system control part 125.

(j) Image Processing Part

The image processing part 135 is a processing device that performs various kinds of signal processing and output characteristics conversion on image data to be supplied through the system control part 125.

Figure 3:
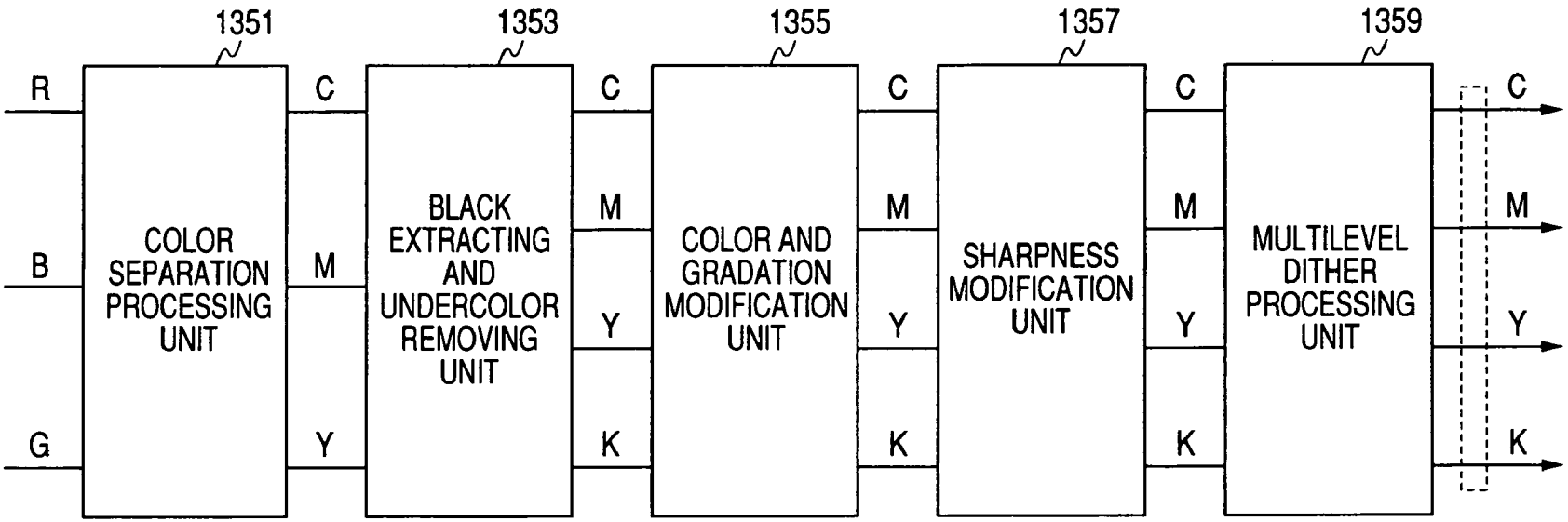
FIG. 3 shows a configuration example of an image processing part.

FIG. 3 shows a configuration example of the image processing part 135. The image processing part 135 includes a color separation processing unit 1351, a black extracting and undercolor removing unit 1353, a color and gradation modification unit 1355, a sharpness modification unit 1357, and a multilevel dither processing unit 1359.

The color separation processing unit 1351 is a processing device that converts RGB signals of loaded image data into CMY signals corresponding to ink colors.

The black extracting and undercolor removing unit 1353 is a processing device that extracts black (K) components from the CMY signals and generates CMYK signals.

The color and gradation modification unit 1355 is a processing device that performs color adjustment and gradation modification processing on the CMYK signals according to need.

The sharpness modification unit 1357 is a processing device that performs sharpening processing and noise removal processing of images on the CMYK signals after color adjustment and the like.

The multilevel dither processing unit 1359 is a processing device that performs multiple tone dither processing of a multiple tone error diffusion method or the like on the CMYK signals after sharpening processing and the like, and generates print data (dot pattern data).

(k) Print Head Control Part

The print head control part 137 is a processing device that converts the print data into head drive signals and controls the injection operation of the print head 119. Under the control of the print head control part 137, independent nozzles that form the print head 119 inject one or plural ink droplets toward a printed medium.

(B) Configuration Example and Control Example of Power Supply Switch Part

Here, a specific configuration example of the power supply switch part 113 will be described. As described above, the power supply switch part 113 supplies current preferentially from the main power supply at the time of normal printing and, when the power is insufficient only by the main power supply in solid printing or high-speed continuous printing, executes the operation of the sub-power supply to supplementarily supply power during power shortage.

It is conceivable that there are methods for realizing the switching operation of the power (supplied power) by the power supply switch part 113 as an autonomous operation based on a logic circuit and as opening and closing control of the switch by the system control part 125.

(a) Logic Circuit Example

Figure 4A:
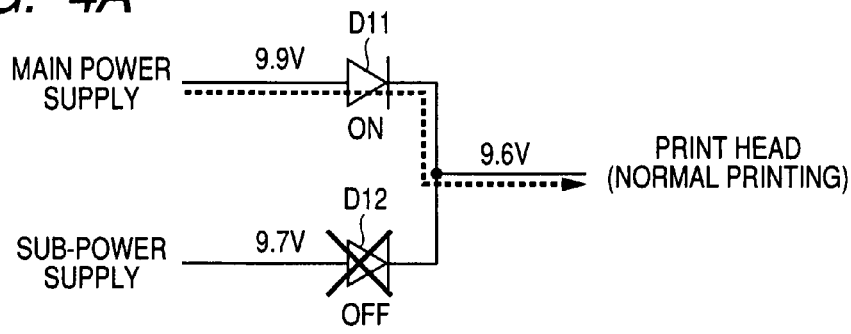
FIGS. 4A and 4B are diagrams for explanation of supply and stop of the sub-power supply using a logic circuit.
Figure 4B:
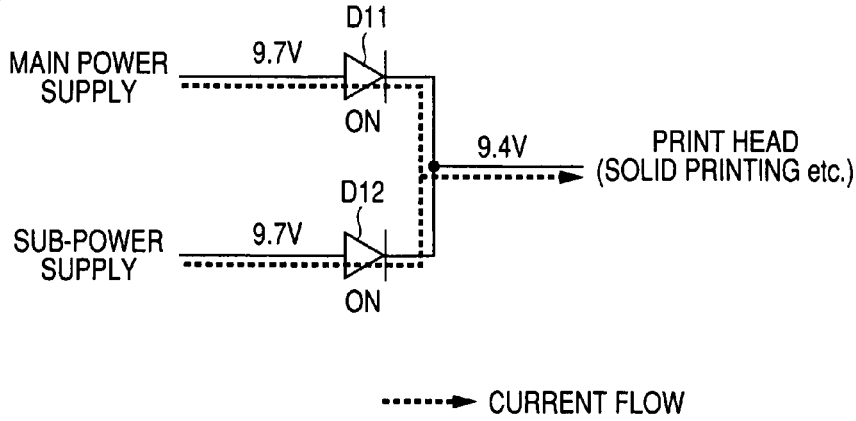

FIGS. 4A and 4B show a circuit example when the power supply switch part 113 is realized as a logic circuit.

In this case, the power supply switch part 113 includes diode element D11 on the power supply line extending from the main power supply and diode element D12 on the power supply line extending from the sub-power supply (after step-up).

The respective diode elements D11 and D12 connect to the power supply lines to the power supplies at anode sides and connect to the power supply lines to the print head at the cathode sides.

The diode elements D11 and D12 perform on- or off-operation according to the potential differences between the anodes and cathodes. That is, the diode elements D11 and D12 function as switches. The diode element D11 typically operates in on-state except the case where a situation of reverse current prevention arises.

The power supply switch part 113 supplies current preferentially from the main power supply at the time of normal printing and, only when a large amount of power is consumed in the print head, replenishes the shortage of the current from the sub-power supply. Accordingly, the voltage of the sub-power supply (after step-up) is set slightly lower than that of the main power supply. Note that the voltage of the sub-power supply (after step-up) is set so as not to hinder the printing quality when the diode element D12 is turned on.

For example, when the main power supply is at 9.9 V, the voltage of the sub-power supply is set to about 9.7 V. That is, an offset voltage of 0.2 V is prepared.

FIG. 4A shows a current supply path at the time of normal printing. In this case, the power consumed in the print head is sufficient with the power supplied from the main power supply. Accordingly, the potential of the power supply line connected to the print head is determined by the anode potential of the diode element D11 at the main power supply side. That is, the potential becomes a potential (9.6 V) lower than the potential of the main power supply by a voltage drop (0.3 V in FIG. 4A).

Simultaneously, the difference between the anode potential and the cathode potential of the diode element D12 at the sub-power supply side is 0.1 V. The potential difference is insufficient for on-operation of the diode element D12. Therefore, only the main power supply preferentially supplies power to the print head 119. During the time, the sub-power supply (high-capacity capacitor) is charged through the main power supply.

By the way, sometimes overall solid printing or similar printing is performed. In this case, the print head needs a very large amount of power for injection operation of a number of ink droplets. Further, when high-speed printing continues, higher energy is necessary for the injection of a number of ink droplets. That is, when the number of injected ink droplets per unit time becomes larger, higher power is necessary.

Accordingly, a phenomenon that the potential of the power supply line connected to the print head side drops is observed. This is caused by the reduction in impedance of the print head due to increase in the number of injected ink droplets of the print head. For example, the cathode potentials of the diode elements D11 and D12 drop to 9.4 V. In this case, the potential difference of 0.3 V is generated between the anode and the cathode of the diode element D12 at the sub-power supply side, and the diode element D12 automatically turns to on-state.

FIG. 4B shows a current supply path in this case. In this case, as shown in FIG. 4B, the supply of current is started from the sub-power supply side toward the print head to replenish the power supply shortage by the main power supply. Consequently, the print head 119 continuously ensures the power necessary for printing. In principle, the present printing operation can be maintained as long as the power shortage can be replenished from the sub-power supply.

Needless to add, when the potential of the power supply line connected to the print head side returns to the normal printing state when the printing state of the print head returns to normal printing or the like, the diode element D12 at the sub-power supply side automatically performs off-operation. That is, the sub-power supply returns to a state of no power supply.

The diode element here is for explanation of switching operation and can be realized as a logic circuit of a transistor circuit or the like as long as the circuit functions as an equivalent diode circuit.

Further, by the combination with status information or the like, the above described power supply operation of the power supplies can be performed only when specific printing contents or printing modes are executed. For example, a switch with operation conditions of solid printing and continuous printing and the diode element D12 may be combined.

Thus, realizing the power supply switch part 113 as a logic circuit enables automatic switching between the supply and supply stop from the sub-power supply even with a simple circuit configuration.

Further, in the circuit configuration, the supply or supply stop from the sub-power supply may be switched according to the actual load condition consumed in the print head.

That is, load variations that change from moment to moment according to printing contents and printing modes can be promptly followed in real time. For example, in solid printing and continuous printing for a long period, a large amount of power is necessary for securing the amount of injected ink droplets, and the power shortage can be replenished in real time regardless of the cause of power shortage.

(b) Opening and Closing Control Example of Switch

Figure 5:
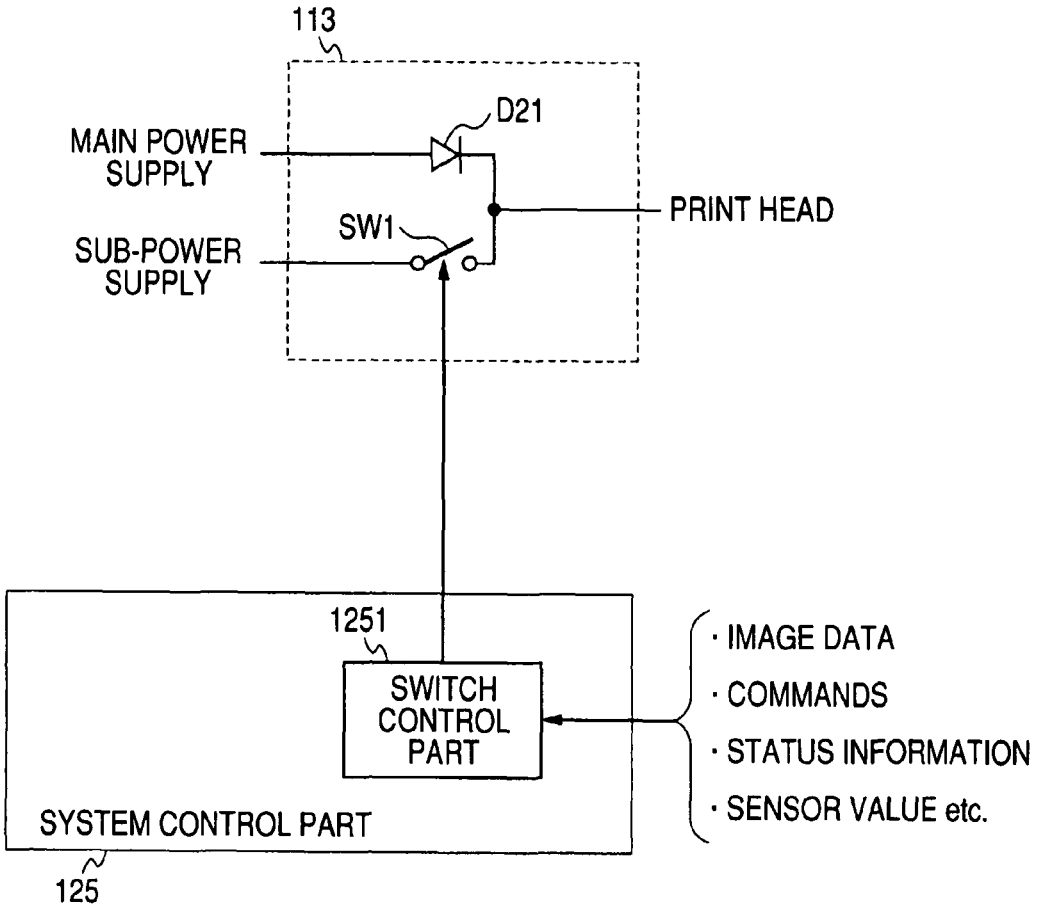
FIG. 5 is a diagram for explanation of supply control and stop control of the sub-power supply using a system control part (a switch control part).

FIG. 5 shows a functional circuit configuration when the power supply switch part 113 is realized by the opening and closing control of the switch.

In this case, switch SW1 that performs opening and closing operation according to external control signals is provided at least on the power supply line connecting the sub-power supply and the print head. The switch SW1 includes a transistor, for example.

Diode element D21 is connected on the power supply line connecting the main power supply and the print head. The diode element D21 is for backward current prevention.

In the case of FIG. 5, the control function of the supplied power by the opening and closing control of the switch SW1 is realized as part of the function of the system control part 125. This function is represented as a switch control part 1251. The switch control part 1251 executes processing of sequentially calculating the power necessary for printing of image data as a subject of processing, processing of determining whether the calculated power exceeds the power supplied from the main power supply or not, and processing of controlling the opening and closing of the switch SW1 according to the determination result.

Here, for calculation of the power, there are methods of calculating the power with respect to image data before the start of printing in unit of pages, calculating the power in units of injection timing of ink droplets, calculating the power in units of printing jobs, etc. Thus, any unit of power calculation may be used.

The power consumed in the print head is affected not only by printing contents (image data) but also by the environmental temperature, print head temperature, number of printed sheets, total number of printed sheets, etc. Therefore, for improving the prediction accuracy, the temperature information, number of printed sheets, or the like is desirably referred to.

The switch control part 1251 compares thus calculated power and corresponding supplied power of the main power supply. Here, when the calculated power exceeds the supplied power of the main power supply, the switch control part 1251 closing-controls the switch SW1. On the other hand, when the calculated power does not exceed the supplied power of the main power supply, the switch control part 1251 opening-controls the switch SW1.

As described above, the power supply switch part 113 is configured by the switch SW1 and the opening and closing operation thereof is controlled from the system control part (the switch control part 1251) side, and thereby, the supply and supply stop of the sub-power supply can be finely controlled using the status information.

Needless to add, in the case of the control technique, the shortage can be replenished in real time regardless of the cause of power shortage.

(C) Configuration Example and Control Example of System Control Part (Printing Start Timing Controller)

Here, one of control technologies for further improving the usability of the printer on the assumption that the sub-power supply is provided will be described.

After the replenishment of power shortage by the sub-power supply, recharge of the sub-power supply becomes naturally necessary. In this regard, it is preferable that printing of the next page is typically started after the recharge is completed, however, sometimes printing of the next page is actually started when the recharge is not completed.

Even in this case, there is no problem if the replenished amount of the power necessary for the next page printing is in the range of the remaining amount of charge of the sub-power supply. However, the printing contents of the next page are arbitrary, and the possibility that the power replenishment from the sub-power supply is insufficient may not be zero according to the printing contents and printing modes.

Therefore, as part of the function of the system control part 125, the control function of printing start timing is realized. The function is called a printing start timing control function.

Figure 6:
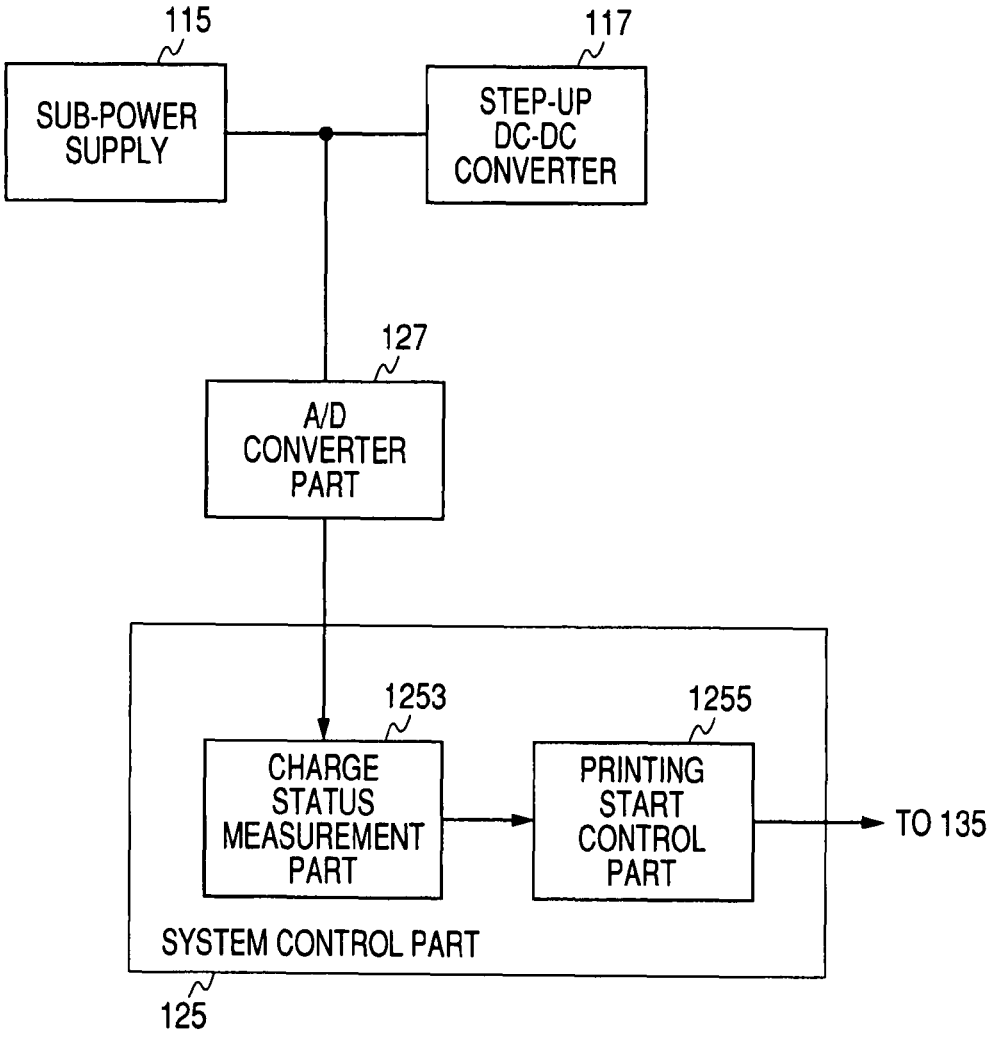
FIG. 6 is a diagram for explanation of printing start timing control using the system control part (a printing start timing control function).

FIG. 6 shows a functional configuration example for realizing the printing start timing control function. The control function is configured by a charge status measurement part 1253 and a printing start control part 1255.

The charge status measurement part 1253 is a processing device that measures the amount of charge of the sub-power supply at least before the start of printing of the next page. The next page here is used in the sense including not only the case where plural pages are contained in one printing job but also the case where single page printing continues at plural times.

In the measurement of the amount of charge (remaining capacity) of the sub-power supply, different techniques are used in the cases where the sub-power supply is a capacitor and a secondary cell.

Figure 7:
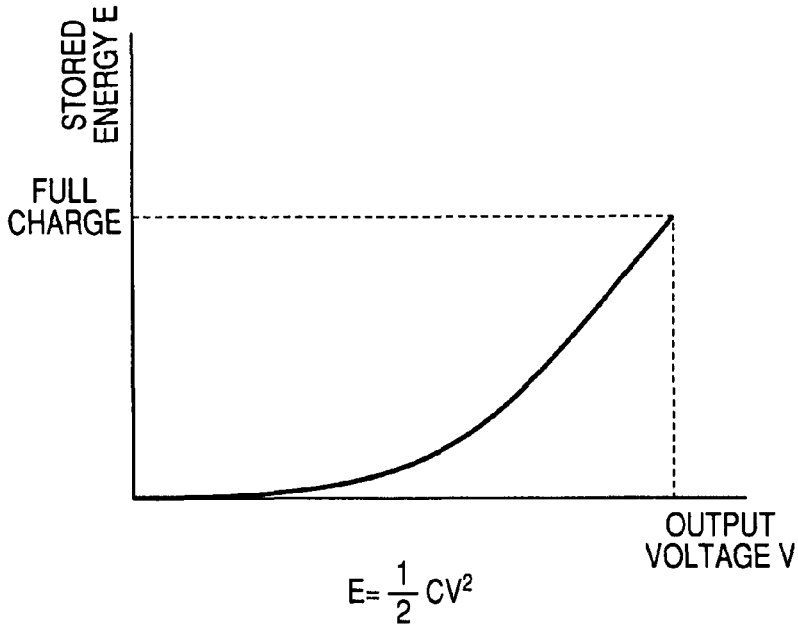
FIG. 7 is a diagram for explanation of a relationship between the output voltage and stored energy when the sub-power supply is configured by a high-capacity capacitor.

When the sub-power supply is a high-capacity capacitor, the relationship shown in FIG. 7 holds between the stored energy (the amount of charge) E of the sub-power supply and the output voltage. In this case, the stored energy (the amount of charge) E can be calculated by $CV^2/2$.

Figure 8:
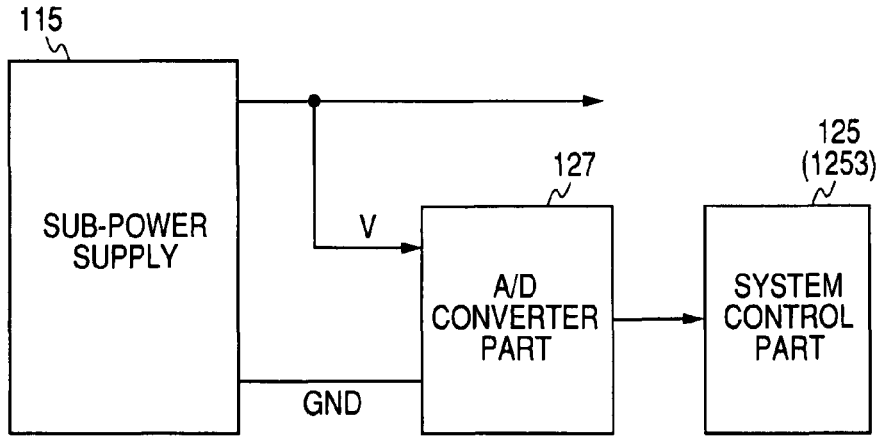
FIG. 8 is a diagram for explanation of a method of detecting the output voltage when the sub-power supply is configured by the high-capacity capacitor.
Figure 9:
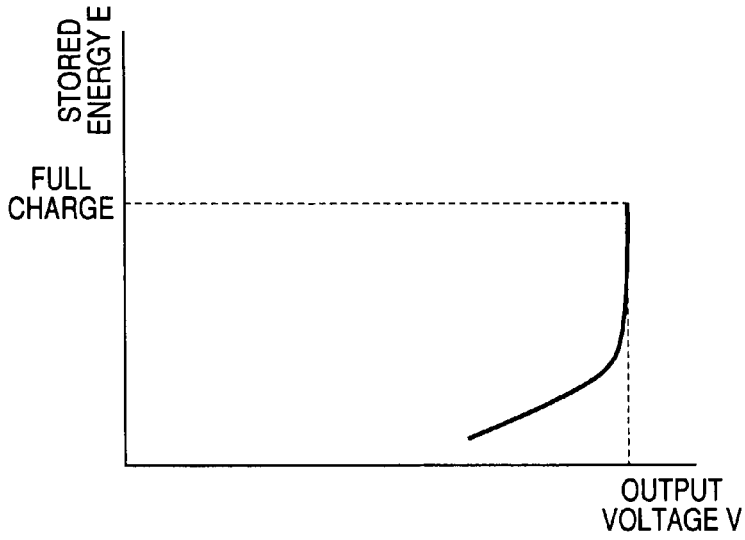
FIG. 9 is a diagram for explanation of a relationship between the output voltage and stored energy when the sub-power supply is configured by a secondary cell.

Therefore, when the sub-power supply is a high-capacity capacitor, as shown in FIG. 8, a technique of A/D converting the output voltage V of the sub-power supply by the A/D converter part 127 and providing the value to the charge status measurement part 1253 is adopted.

Figure 10:
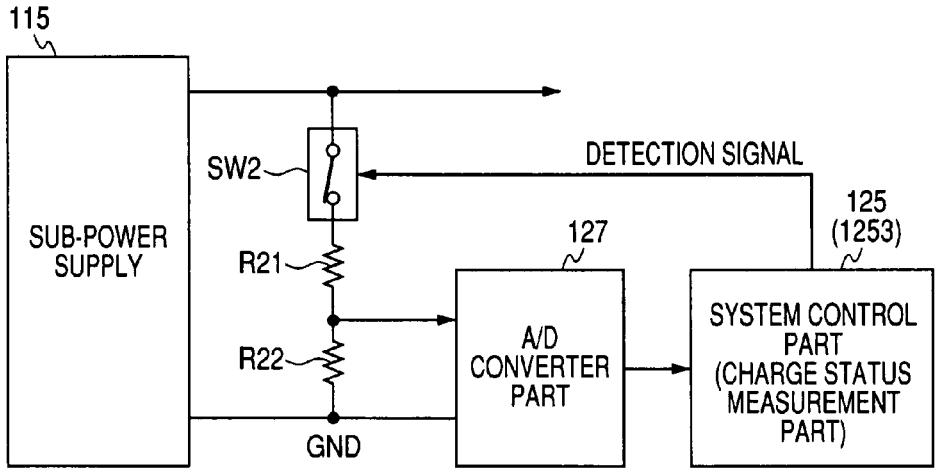
FIG. 10 is a diagram for explanation of a method of detecting the output voltage when the sub-power supply is configured by the secondary cell.

On the other hand, when the sub-power supply is a secondary cell, the stored energy (the amount of charge) E of the sub-power supply and the output voltage do not satisfy the relationship shown in FIG. 7. Generally, the stored energy of the secondary cell is related to the impedance variations within the cell. That is, when the stored energy becomes lower, the impedance within the cell increases. Accordingly, a technique of indirectly obtaining the stored energy (the amount of charge) E using a detection circuit shown in FIG. 10 is adopted.

That is, a technique of inserting a serial circuit formed by detection switch SW2 and dummy resistances R21 and R22 between the power supply line and ground line GND of the sub-power supply, and detecting the voltage value generated from the current flowing in the dummy resistances R21 and R22 when the detection switch SW2 is closed by the A/D converter part 127 is adopted.

The detected voltage value is divided in a resistance ratio of the dummy resistances R21 and R22. Therefore, in the charge status measurement part 1253, the stored energy (the amount of charge) E of the sub-power supply is estimated in consideration of the voltage drop.

Here, opening and closing of the detection switch SW2 is controlled by the charge status measurement part 1253.

The charge status measurement part 1253 measures the stored energy (the amount of charge) E of the sub-power supply on a temporary basis or before printing of the next page according to the technique and provides the measurement value to the printing start control part 1255.

The printing start control part 1255 stops the printing start of the next page by the print head 119 when the measured amount of charge is less than the criterion value (the full amount of charge), and permits the printing start of the next page by the print head 119 when the measured amount of charge satisfies the criterion value (the full amount of charge).

When the printing start control part 1255 stops the printing start, charging of the sub-power supply progresses using the time and the power can be accumulated to the full capacity. For example, the power can be accumulated to the power capable of the output of 10.45 A.

If such control function of printing start timing is provided in the system control part 125, even when the load that needs the maximum capacities of the main power supply and the sub-power supply is applied on the print head during the printing of the next page, necessary power supply can be secured. Therefore, situations such that the operation is interrupted after the start of printing and printing image quality is deteriorated can be eliminated.

Although the time of full charge has been used as a criterion to determine whether the start of printing is permitted or not, a value smaller than the full charge can be used when the maximum power that can be supplied by the main power supply and the sub-power supply is sufficient. In this case, the printing start timing is minimized in a range in which there is no practical issue.

(D) Configuration Example and Control Example of System Control Part (Printing Execution Timing Controller)

Here, another of control technologies for further improving the usability of a printer on the assumption that the sub-power supply is provided will be described.

In the immediately preceding description, the case where the charge status of the sub-power supply is confirmed before the start of printing of the next page so that the power shortage may not occur after the start of printing of the next page has been described.

In this regard, the following points should be noted in the method of confirming the charge status of the sub-power before the start of printing of the next page.

One point to be noted is that the determination as to whether the printing is permitted or not according to the charge status of the sub-power supply is desirably made before the execution of paper feed operation of the next page. In this regard, when whether the printing is permitted or not is determined after the start of paper feed operation of the next page, variations in standby time from the completion of paper feed to the start of depicting are unavoidable. Practically, when the printing start is stopped after the completion of paper feed and the standby time for printing becomes longer, the contact marks may be left on the printing paper. Therefore, from the viewpoint of keeping the printing quality constant, it is found that the determination as to whether the printing is permitted or not according to the charge status of the sub-power supply is desirably made before the execution of paper feed operation of the next page.

Another point to be noted is that the determination as to whether the printing is permitted or not according to the charge status of the sub-power supply is desirably made before the start of calculation with the printing of the next page. In the case of a printing sequence for starting the depicting after the entire calculation with the printing of the next page is ended, when the determination to stop the start of printing is made after the start of calculation, standby is necessary while keeping the calculation result until the charging of the sub-power supply is completed even after the calculation is ended. The time is unnecessary standby time in calculation processing. Therefore, in view of effective utilization of calculation resources within the printer, it is desirable that such standby time is not brought about.

Accordingly, as part of the function of the system control part 125, a function of controlling the standby time (printing standby time) from the end of printing to the start of the next printing in advance according to the charge status of the sub-power supply is proposed. This function is called a printing standby time control function.

Figure 11:
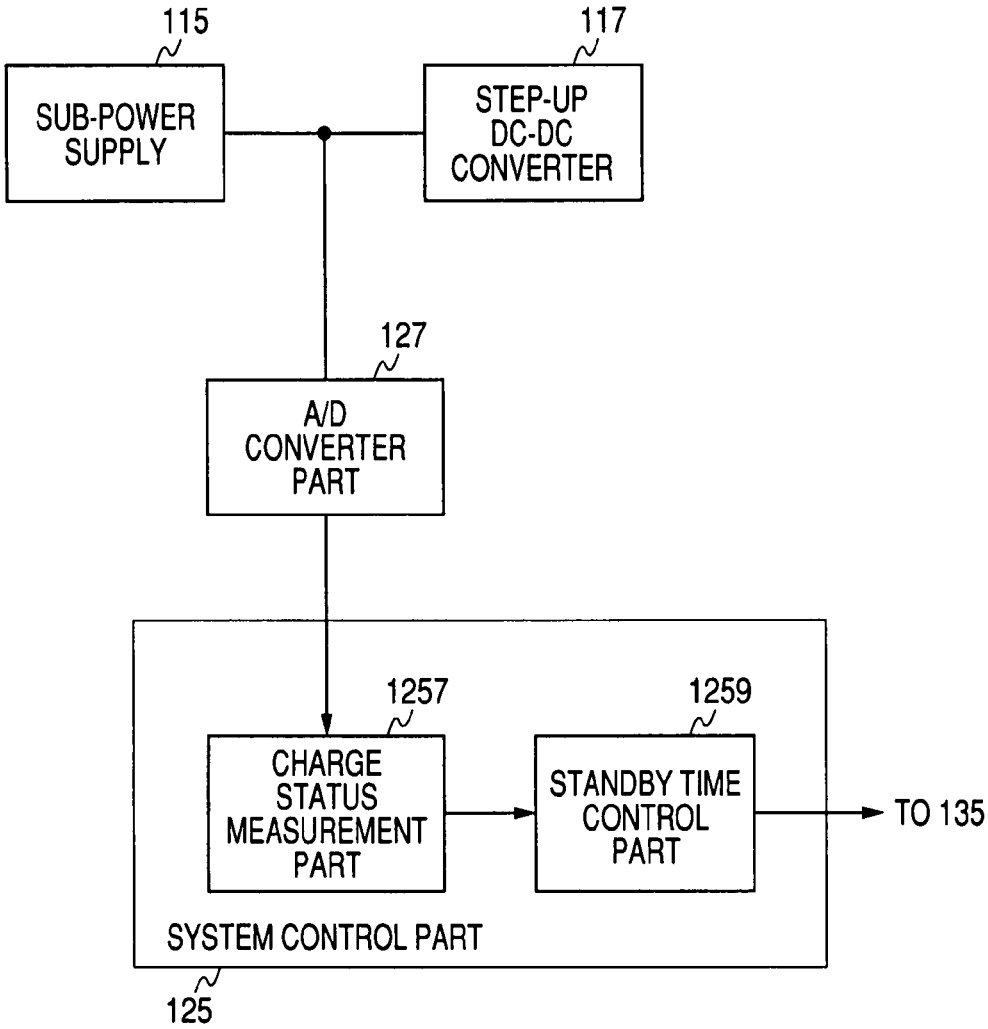
FIG. 11 is a diagram for explanation of printing start timing control using the system control part (a printing standby time control function).

FIG. 11 shows a functional configuration example for realizing the printing standby time control function. The control function is configured by a charge status measurement part 1257 and a standby time control part 1259.

The charge status measurement part 1257 is a processing device that measures the amount of charge of the sub-power supply at least at the time when printing of each page is ended (after printing is ended). It is the same as the charge status measurement part 1253 (FIG. 6) of measuring the amount of charge of the sub-power supply before the start of printing of the next page in the point where the measurement method differs according to the configuration of the sub-power supply.

The standby time control part 1259 is a processing device that controls the printing standby time until the start of printing of the next page according to the measured amount of charge.

For example, when the printing immediately before the measurement is executed only with the main power supply, the standby time control part 1259 sets the printing standby time to the sum of the time necessary for paper feed and ejection and the time necessary for rising to or falling from the maximum printing current.

Further, for example, when power is supplied from the sub-power supply to the printing immediately before the measurement, the standby time control part 1259 sets the printing standby time to the longer one of the sum of the time necessary for paper feed and ejection and the time necessary for rising to or falling from the maximum printing current and the time necessary for completion of charging.

The system control part 125 advances the preparation for printing of the next page according to the printing standby time. Consequently, the paper feed timing of printing paper is optimized, and the time from the completion of paper feed to the start of actual depicting can be fixed. That is, the printing quality can be kept constant.

Further, even in the case of a printing sequence for starting the depicting after the entire calculation with the printing of the next page is ended, the calculation processing can be synchronized with the start of the next printing, and thus, unnecessary standby time can be eliminated.

(E) Optimization of Capacity Ratio

Here, an optimization technology of the power supply capacity of the main power supply and the power supply capacity of the sub-power supply will be described.

Both immediately preceding two descriptions are on the assumption that the printing standby time between pages varies according to the charge status (from no charge to full charge). Accordingly, when the printing standby time varies, the number of printed sheets per unit time also varies.

For example, in the relationship between the power supply capacity of the main power supply connected to a commercial power source and the power supply capacity of the sub-power supply, when the rate of the capacity of the main power supply is reduced while the rate of the capacity of the sub-power supply is increased, the chances that the power is supplied from the sub-power supply are increased. In this case, the number of printed sheets per unit time varies more easily.

For example, when the overall solid printing is continued, the time necessary for charging of the sub-power supply inevitably becomes longer, and consequently, the number of printed sheets per minute is reduced.

To solve the problem, it is necessary that the power supply capacity of the main power supply is increased and the power supply capacity of the sub-power supply is reduced. However, the increase in the power supply capacity of the main power supply goes against the reduction in capacity of the main power supply as the main subject of the specification.

Accordingly, a method of optimizing the capacity ratio of the main power supply and the sub-power supply is proposed so that the charging time of the sub-power supply may be absorbed in the time critical for the execution of printing operation (the time necessary for paper feed and ejection and calculation).

That is, a method of setting the power supply capacities of the main power supply and the sub-power supply is proposed so that the printing standby time may be usually constant with or without charging.

FIG. 12 shows an experimental result confirmed between the capacity ratio of the main power supply and the sub-power supply and the charging time of the sub-power supply.

FIG. 12 shows how the charging time changes according to the difference in the capacity ratio of the main power supply and the sub-power supply when the maximum load is applied at a constant voltage of 9.9 V (when printing current of 20.90 A flows).

Here, given that the minimum time necessary during execution of printing is two seconds, a boundary condition for absorption of the charging time of the sub-power supply within the two seconds when the maximum load is applied is that the capacity of the main power supply is 14.93 A or more and the capacity of the sub-power supply is 5.97 A or less in the printer.

Therefore, as far as the driving condition assumed in the embodiment is concerned, the printing standby time can be typically kept constant by providing the main power supply having a capacity of 14.93 A or more and the sub-power supply having a capacity of 5.97 A or less.

That is, when the power supply capacity of the sub-power supply is ½.5 or less of the power supply capacity of the main power supply, the printing standby time can be typically kept constant regardless of printing contents or printing modes. In other words, a prescribed printing speed can be kept regardless of printing contents or the like.

Needless to add, these numerical values are one example, and the capacity ratio of the main power supply and the sub-power supply changes when the applied voltage, the maximum printing current, the acceptable charging time, or the like changes.

Further, when the main power supply is too large as described above, it goes against the reduction in capacity of the main power supply, and thus, it is necessary that the maximum value of the power supply capacity of the main power supply is set in consideration of the condition of packaging.

(F) Other Embodiments (a) The above described technologies may be applied to business-use or personal-use printers. For example, they may be also applied to office printing machines, medical printing machines, photo printing machines, copy machines, facsimile machines, general-purpose printing machines, video printing machines, etc.

The printer may be provided with a device for other than the printing function, such as a display device and a scanner.

Further, the printer may be provided with a high-capacity storage device for storing image data. As the high-capacity storage device, for example, a hard disk drive, a semiconductor memory, an optical memory medium, or the like may be used.

(b) Of the above described technologies, regarding the function of controlling the power supply operation of the sub-power supply, the equal function may be realized as hardware or software.

Further, not only all of these processing functions are realized by hardware or software but also part of the functions may be realized by hardware or software. That is, a configuration formed by combining hardware and software may be used.

(c) Various modified examples are conceivable within the range of the intent of the invention for the above described embodiments. Further, various kinds of modifications and applications created based on the description of the specification are also conceivable.

It should be understood by those skilled in the art that various modifications, combinations, sub-combinations and alterations may occur depending on design requirements and other factors insofar as they are within the scope of the appended claims or the equivalents thereof.

What is claimed is:

1. A printer comprising:

an inkjet print head;

an image processing part that processes image data and supplies the data to the print head;

a main power supply that is connected to a commercial power source and supplies first power to the print head;

a rechargeable sub-power supply that supplies second power for supplementing the first power to the print head when necessary for driving the print head; and a switch part that electrically connects the sub-power supply to the print head, and further comprising circuitry for automatically sensing an electrical supply condition at an input to the print head and wherein the switch part automatically supplies supplemental electrical energy when electrical supply condition falls below a predetermined level, and further wherein the main power supply provides a motor drive power output and a logic circuitry power output and the sub-power supply exclusively provides supplemental power to the print head of the printer.

2. The printer according to claim 1, wherein the switch part is a diode circuit connected in a forward direction of the power supply line and power supply from the sub-power supply is started when a potential difference equal to or more than a forward voltage drop is generated between ends of the diode circuit.

3. The printer according to claim 1, further comprising a switch control part that closing-controls the switch part when power shortage occurs during continuous printing.

4. A supplied power controller in a printer provided with an inkjet print head, an image processing part that processes image data and supplies the data to the print head, a main power supply that is connected to a commercial power source and supplies first power to the print head, a rechargeable sub-power supply that supplies second power for supplementing the first power to the print head when necessary for driving of the print head, and a switch part that electrically connects the sub-power supply to the print head, and further comprising circuitry for automatically sensing an electrical supply condition at an input to the print head and wherein the switch part automatically supplies supplemental electrical energy when electrical supply condition falls below a predetermined level; wherein the main power supply provides a motor drive power output and a logic circuitry power output and the sub-power supply exclusively provides supplemental power to the print head of the printer.

* * * * *